United States Patent [19]

Eheim, deceased et al.

[11] Patent Number: 4,664,081

[45] Date of Patent: May 12, 1987

[54] FUEL INJECTION SYSTEM FOR DIESEL INTERNAL COMBUSTION ENGINES, IN PARTICULAR VEHICLE DIESEL ENGINES

[75] Inventors: Franz Eheim, deceased, late of Stuttgart, by Helga Eheim, heir; Gerald Hofer, Weissach-Flacht; Max Straubel, Stuttgart, all of Fed. Rep. of Germany

[73] Assignee: Robert Bosch GmbH, Stuttgart, Fed. Rep. of Germany

[21] Appl. No.: 763,594

[22] Filed: Aug. 8, 1985

[30] Foreign Application Priority Data

Aug. 16, 1984 [DE] Fed. Rep. of Germany ..... 3430141

[51] Int. Cl.[4] ..... F02M 39/00

[52] U.S. Cl. ..... 123/380; 123/383; 123/365

[58] Field of Search ..... 123/373, 382, 383, 364, 123/380, 365, 449

[56] References Cited

U.S. PATENT DOCUMENTS 2,414,617 1/1947 Sommers ..... 123/365
2,961,229 11/1960 Parks ..... 123/364
4,192,272 3/1980 Lang ..... 123/380
4,432,321 2/1984 Matsuda ..... 123/380
4,469,066 9/1984 Yuzawa ..... 123/380

*Primary Examiner*—Carl Stuart Miller
*Attorney, Agent, or Firm*—Edwin E. Greigg

[57] ABSTRACT

A fuel injection system for Diesel internal combustion engines, particularly vehicle Diesel engines, is proposed which has a full-load stop dependent on atmospheric pressure. The position of the full-load stop which adapts the injection quantity to the variable ambient air pressure is derived from an air pressure adjusting member and transmitted onto the full-load stop via a transmission member. A locking mechanism, which locks the transmission device in a plurality of positions counter to the force exerted by the full-load stop, is associated with the transmission member. The transmission member has two disks draggably coupled within a predetermined range, one of which disks is actuated by the air pressure adjusting member and the other of which disks cooperates with the full-load stop. The draggable coupling effects an adjustment of the full-load stop, if the full-load stop is relaxed, so that the air pressure adjusting member need exert no more than a small adjusting force.

8 Claims, 1 Drawing Figure

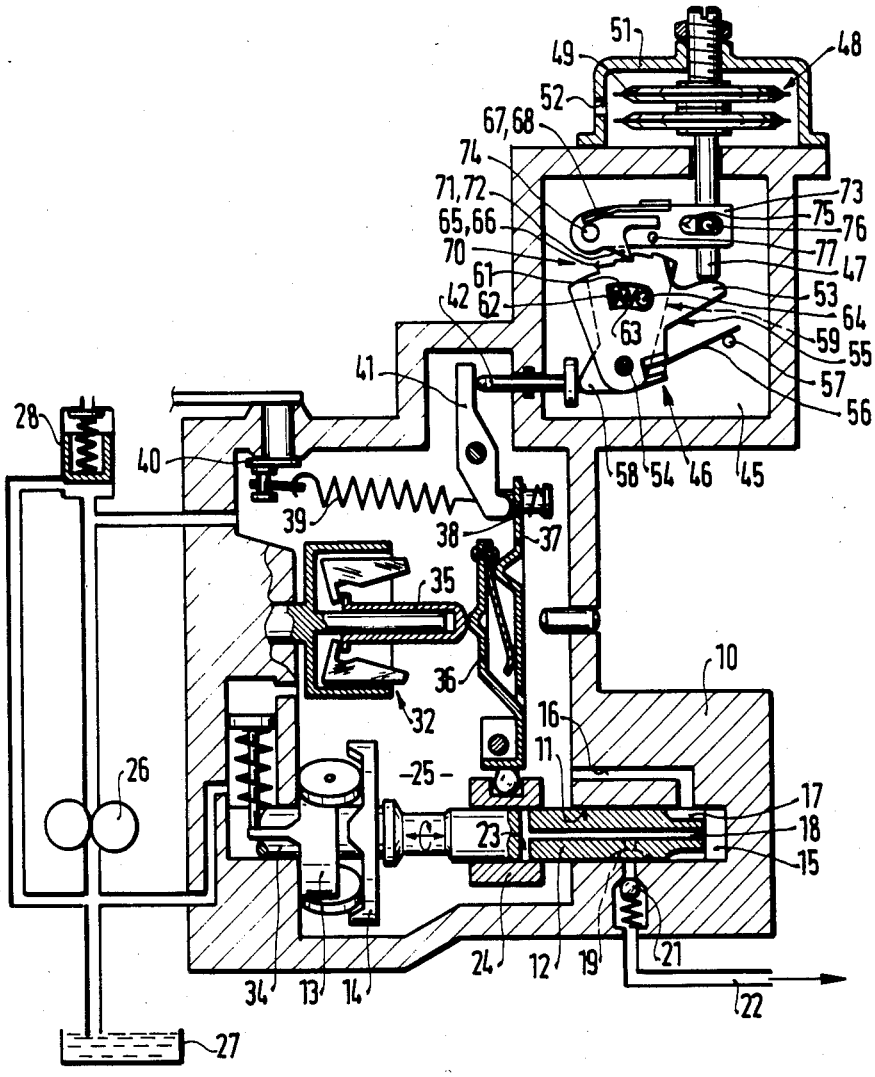
51
49
48
52
67,68
74
71,72
73
65,66
75
76
70
77
61
47
42
62
53
64
63
59
55
41
57
56
28
40
58
54
46
45
39
38
37
35
10
36
32
16
11
26
25
17
18
23
15
24
12
19
21
34
13
14
22
27

FUEL INJECTION SYSTEM FOR DIESEL INTERNAL COMBUSTION ENGINES, IN PARTICULAR VEHICLE DIESEL ENGINES

BACKGROUND OF THE INVENTION

The invention is based on a fuel injection system as generally defined hereinafter. At higher altitudes, because of the lower air density, the aspirated air mass is smaller. The full-load quantity that is injected cannot be combusted completely, causing smoke to develop and the engine temperature to rise. In order to prevent this, an injection system of the above general type is known from European Patent A No. 0012309 (FIG. 1), having a full-load stop that is dependent on atmospheric pressure and that varies the full-load quantity in accordance with the air pressure. In this injection system, the control stroke of the air pressure control member is converted and transmitted via a conical cam connected to the adjusting rod of the adjusting member and via a scanning pin that is displaceable transversely with respect to this cam. The air pressure adjusting member, which comprises a plurality of barometer boxes, has a relatively low working capacity if its dimensions are small, which is possible when the member is used in combination with an injection system.

OBJECT AND SUMMARY OF THE INVENTION

The fuel injection system according to the present invention has the advantage over the prior art that an air pressure adjusting member having a relatively low working capacity can be used, because by means of the locking mechanism associated with the transmission device, a change in the position of the full-load stop is undertaken only if this stop is relieved, for instance when the driver lets up on the accelerator, so that no notable force is exerted upon the air pressure adjusting member.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing shows an exemplary embodiment of the invention in simplified form, in a sectional view of a distributor injective pump having a full-load stop dependent on atmospheric pressure.

DESCRIPTION OF THE PREFERRED EMBODIMENT

In the reciprocating piston distributor injection pump shown, a pump piston 12 operates in a cylinder bore 11 of a housing 10 and in a manner known per se is set into both reciprocating and rotating motion at the same time by a cam drive comprising a roller ring 13 and a face cam disk 14. A pump work chamber 15 acted upon by the pump piston 12 is filled during the intake stroke of the pump piston 12 via an intake bore 16 and control grooves 17 of the pump piston 12, and during the compression stroke of the pump piston 12, with the intake bore 16 closed, fuel is pumped via a longitudinal bore 18 and a supply groove 19 communicating therewith and via a pressure valve 21 and a pressure line 22 to an injection nozzle, not otherwise shown, at the engine cylinder. At the end of fuel pumping, i.e. supply, a transverse bore 23 of the pump piston 12, which bore communicates with the longitudinal bore 18, is opened up by an axially displaceable governor slide 24. The fuel supplied to the pump work chamber 15 via the intake bore 16 is drawn from an inner chamber 25 of the injection pump which serves as a suction chamber, and fuel diverted from the transverse bore 23 by the governor slide 24 can also flow back to this inner chamber 25. Fuel is pumped to the inner chamber 25 by a pre-supply pump 26 from a supply container 27, the supply pressure of which is controlled in accordance with rpm by a pressure control valve 28. A centrifugal rpm governor 32, which is set into rotary motion by a drive shaft 34 which also drives the face cam disk 14 of the cam drive in a manner not otherwise shown, actuates the governor slide 24 in a manner known per se via a governor sleeve 35 and a governor lever 36; the governor slide 24 acts as the supply quantity adjusting member of the reciprocating piston distributor injection pump. The axial position of the governor slide 24, which is adjusted by the governor lever 36, controls the end of supply and thus the injection quantity of the pump. In the illustrated full-load position of the governor parts, the governor lever 36 is resting on a tension lever 37, the deflection of which is limited by the position of a full-load stop 38. A governor spring 39 also acts upon the tension lever 37 and is articulated on an rpm adjusting lever 40 connected to the accelerator pedal. The initial tension of the governor spring 39 which keeps the tension lever 37 in contact with the full-load stop 38 determines the breakaway rpm.

The full-load stop 38 is embodied by one arm of a two-armed stop lever 41, the second arm of which is supported on a pin 42. The pin 42, which is guided in the wall of the pump housing 10 by means of a seal and a narrow sliding fit, which prevents the passage therethrough of fuel, protrudes with its other end into a chamber 45, where it communicates with a conversion and transmission device 46. An adjusting rod 47 of an air pressure adjusting member 48, which comprises two diaphragm phragm boxes 49 disposed in series with one another, also protrudes into the chamber 45. The diaphragm boxes 49 are surrounded by a protective cover 51, the interior of which communicates by means of a bore 52 with the ambient air.

The free end of the adjusting rod 47 of the air pressure adjusting member 48 presses against a lever arm 53 of a segmental disk 55 supported pivotably on a pin 54, counter to the action of a leaf spring 56 secured on the disk 55 and supported on another pin 57. The pin 42, which is oriented at right angles to the adjusting rod 47, presses against a cam or lever arm 58 on a second segmental disk 59, which likewise is pivotable on the pin 54 and for the most part is coincident with the first disk 55. The two disks 55 and 59 are pivotable relative to one another over a limited angular range and are coupled together in a yielding, draggable manner. To this end, the first disk 55 has an elongated hole 61 and a tongue 62, on which a helical spring 63 is seated. The other end of the spring 63 is suspended on a bolt 64, which protrudes from the other disk 59 into the hole 61 in the first disk 55. Both disks 55, 59 are fixable in one direction in a plurality of positions by means of a locking mechanism 70, specifically such that the force transmitted by the full-load stop 38 via the lever 41 and the pin 42 onto the disk 59 is intercepted by the locking mechanism 70, and is not transmitted onto the diaphragm boxes 49. To this end, the disks 55, 59 have a circumferential area having detents 65, 66 stepped radially to the pivot axis. Matching latches 71, 72 loaded by lead springs 67, 68 engage the detents 65, 66 of each disk 55, 59. The latches 71, 72 are pivotably supported on a lever 73, which is rotatable on a pin 74 and has a longitudinal hole 75, which is engaged by a pin 76 on the adjusting rod 47. The path of the latches 71, 72 to engage the detents is limited by a stop pin 77 on the lever 73.

OPERATION

The full-load stop adjusting apparatus described above, which is dependent on atmospheric pressure, functions as follows:

At a predetermined ambient air pressure, the adjusting rod 47 of the air pressure adjusting member 48 keeps the first disk 55 in a predetermined position, in which the latch 71 associated with it engages a predetermined detent 65. By means of the yielding coupling of the second disk 59 with the first disk 55 within a predetermined angular range, which is effected by the perimetral wall or hole 61 in the disk 55, the bolt 64 of the other disk 59 engaging this enclosed wall 61, and the spring 63 disposed between them, the second disk 59 assumes a position which corresponds to the first disk 55, in which position the latch 72 associated with it engages one of the detents 66. The disk 59 retains the full-load stop 38 in a predetermined position via its lever arm 58, the pin 42 and the stop lever 41.

When the air pressure is dropping, such as when driving uphill, the diaphragm boxes 49 expand and move the adjusting rod 47 downward, pivoting the first disk 55 clockwise. The other disk 59, because it is loaded by the governor spring 39, remains locked in its original position. Only when the next letup on the accelerator pedal occurs, when the governor spring 39 is relaxed, does the spring 63, which has in the meantime become tensed, drag the second disk 59 along, until its latch 72 likewise engages a detent in the same manner. As the second disk 59 follows along, its lever 58, via the pin 42 and the stop lever 41, causes the full-load stop 38 to assume a position associated with the prevailing ambient air pressure. By means of the locking mechanism 70 embodied by the detents 65, 66, the disks 55, 59 and the latches 71, 72, the full-load stop 38 is retained in the new position even when the governor spring 39 is fully tensed, a position in which the deflection of the tension lever 37 is limited to a greater degree, so tht a reduced full-load quantity is correspondingly pumped. As the vehicle continues to move uphill, the process is repeated in the same manner.

With increasing ambient air pressure for example when driving downhill, the process takes its course in the opposite direction. The diaphragm boxes 49 contract and move the adjusting rod 47 upward, whereupon by the pivoting of the lever 73 the two latches 71, 72 are raised out of the detents 65, 66 and the locking mechanism 70 is unlocked, either then, or at the latest the next time there is a letup on the accelerator pedal, when the governor spring 39 is relaxed. The lever arm 53 following after the end of the adjusting rod 47 pivots the first disk 55 counterclockwise. The disk 55 then presses one wall defining the opening 61 against the bolt 64 of the other disk 59, thereby pivoting that disk as well and thereby adjusting the full-load stop 38 in the direction of a larger fuel injection quantity.

From the above, it will be appreciated that the adjustment of the full-load stop in order to adapt the injection quantity to the pressure of the ambient air is undertaken not in an infinitely graduated manner, as in known injection systems, but rather in small stages, each time when shifting occurs, or in other words with the accelerator pedal relieved, that is, at an instant when the contact force of the tension lever 37 on the full-load stop 38, resulting from the governor spring 39, is relieved. As a result, an adjustment of the full-load stop in accordance with atmospheric pressure is attained, even with pressure boxes exerting small adjusting forces.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for Diesel internal combustion engines, comprising a fuel injection pump, a supply quantity adjusting device, including an adjusting lever and a governor spring acting thereupon, a governor, a full-load stop adapted to act upon said adjusting lever counter to said governor spring and adjustable via a transmission device by an air pressure adjusting member influenced by pressure of ambient air, said transmission device further includes a locking mechanism between said air pressure adjusting member and said full load stop supported in a stationary manner and adapted to be locked in a plurality of positions comprising two relatively movable members, a first member pivotable on a stationary supported axis and biased via said adjusting lever when abutting said full load stop, thereby being held at a locking part of said locking mechanism in a locked position, a second member pivotable on said stationary supported axis, yieldingly connected to said first member and acted upon by said air pressure adjusting member which is further connected to said locking part for unlocking said first member upon movement in an unlocking direction.

2. A fuel injection system for Diesel internal combustion engines, comprising a fuel injection pump, a supply quantity adjusting device, a full-load stop adapted to act upon said supply quantity adjusting device and in combination with an air pressure adjusting member adapted to limit the supply quantity in accordance with atmospheric pressure, said full-load stop having a variable position defined via a transmission device by an air pressure adjusting member influenced by the pressure of ambient air, and said transmission device further includes a locking mechanism between said air pressure adjusting member and said full load stop supported in a stationary manner and adapted to be locked by said locking mechanism counter to a force exerted by said full-load stop; said locking mechanism further includes two coaxially pivotable relatively movable members, said two members being further draggably coupled within a predetermined range and include a surface area provided with matching, radially stepped detents, said detents adapted to cooperate with means on a lever which articulates on said air pressure adjusting member; one of said members being actuated by said air pressure adjusting member and the other of said members being adapted to cooperate with said full-load stop.

3. A fuel injection system as defined by claim 1, further wherein said transmission device is further adapted to be locked by said locking mechanism counter to a force exerted by said full-load stop.

4. A fuel injection system as defined by claim 2, further wherein said means which cooperates with said detents comprise latch members.

5. A fuel injection system as defined by claim 4, further wherein said detents and said latch members are adapted to block movement of said two relatively movable members of said transmission device which would be caused by the exertion of force from said full-load stop.

6. A fuel injection system as defined by claim 2, further wherein said lever further includes a stop means which is adapted to cooperate with latch means, whereby upon a drop in air pressure and movement of said air pressure adjusting member said stop means disengages said latch means.

7. A fuel injection system as defined by claim 4, further wherein said lever further includes a stop means which is adapted to cooperate with latch means, whereby upon a drop in air pressure and movement of said air pressure adjusting member said stop means disengages said latch means.

8. A fuel injection system as defined by claim 5, further wherein said lever further includes a stop means which is adapted to cooperate with latch means, whereby upon a drop in air pressure and movement of said air pressure adjusting member said stop means disengages said latch means.

* * * * *